US007332996B2

(12) United States Patent
Hague

(10) Patent No.: US 7,332,996 B2
(45) Date of Patent: Feb. 19, 2008

(54) CONNECTIONS FOR A CELL SITE ENVIRONMENTAL CONTROL SYSTEM

(75) Inventor: Edward K. Hague, Los Altos, CA (US)

(73) Assignee: Sierra Monitor Corporation, Milpitas, CA (US)

( * ) Notice: Subject to any disclaimer, the term of this patent is extended or adjusted under 35 U.S.C. 154(b) by 355 days.

(21) Appl. No.: 11/173,602

(22) Filed: Jul. 1, 2005

(65) Prior Publication Data

US 2007/0001838 A1 Jan. 4, 2007

(51) Int. Cl.
*G08B 23/02* (2006.01)

(52) U.S. Cl. ..... 340/3.1; 340/539.1; 340/3.22; 340/3.8

(58) Field of Classification Search ..... 340/539.1, 340/3.1, 3.22, 3.42, 3.8, 3.9
See application file for complete search history.

(56) References Cited

U.S. PATENT DOCUMENTS

| | | | | |
|---|---|---|---|---|
| 4,212,078 | A * | 7/1980 | Games et al. | 700/2 |
| 4,897,798 | A * | 1/1990 | Cler | 700/276 |
| 6,402,043 | B1 * | 6/2002 | Cockerill | 236/78 D |
| 6,449,533 | B1 * | 9/2002 | Mueller et al. | 700/276 |

* cited by examiner

*Primary Examiner*—Benjamin C. Lee
*Assistant Examiner*—Travis R. Hunnings
(74) *Attorney, Agent, or Firm*—Morgan, Lewis & Bockius LLP; Craig P. Opperman

(57) ABSTRACT

A cell site environmental control system includes multiple relays, each monitoring a specific device whose status may have an impact on the environmental condition at the cell site. The cell site environmental control system includes a microprocessor-based central control module that issues environmental control instructions upon receipt of monitoring signals from the monitoring relays. The monitoring signals are captured at a punch-down block that has connections to the monitoring relays and routed from the punch-down block to the central control module.

31 Claims, 2 Drawing Sheets

CONNECTIONS FOR A CELL SITE ENVIRONMENTAL CONTROL SYSTEM

FIELD OF THE INVENTION

The present invention relates generally to control of environmental conditions within a building, and in particular to connecting in an environmental control system that gathers information about conditions by leveraging off existing cell phone network building infrastructure.

BACKGROUND

A successful cell phone network requires a large number of continuously operating cell sites. But, there are many situations, natural or man-made, that may affect adversely the continuous operation of a cell site. For example, if some equipment at a cell site is over-heated or even destroyed during the summer, the cell site cannot maintain normal operation and has to be shut down at least temporarily. This situation is very common if the cell site does not install necessary air conditioning units or if the air conditioning units are powered by unreliable utility power and there is not sufficient backup power supply (e.g., backup batteries) at the cell site.

Conventional detection instruments installed at a cell site send monitoring signals to a remote monitoring station when certain predefined conditions are met. But they usually do not have the capability of adjusting automatically the environment of the cell site in response to these conditions, e.g., by switching on a cooling fan or turning off one or more communication channels to lower the temperature inside a building. When an adverse condition occurs, an operator at the monitoring station often has no choice but to shut down the cell site completely until technicians arrives to fix the problems on-site. This approach not only reduces the reliability of the cell phone network but also increases the network carrier's cost.

FIG. 1 is a diagram illustrating a prior art cell site environmental control system, for example, as proposed by companies such as Nextel Communications. This system is used for monitoring and controlling the environment at a cell site so as to improve the reliability of the cell site. For simplicity, FIG. 1 lists only three detectors, AC fault circuit 102, utility power circuit 104 and generator power circuit 106, each circuit coupled to a respective switch circuit, e.g., general-purpose relay or switch, 114, 118 or 122. The closure or opening of a relay or switch indicates a change of state at one particular detector.

The output terminals of the relays are connected to a device that connects one group of wires to another group of wires through a system of metal pegs that the wires are attached, e.g., a punch-down block 110 having multiple rows of terminals. Any state detected by a detector triggers the closure or opening of a corresponding relay or switch, which serves as a monitoring signal. The monitoring signal is transmitted from the relay to the punch-down block 110 and then to a site controller 112 via a cable 111. The site controller 112 then transmits the monitoring signal to a central monitoring station located remotely.

Of course, not every monitoring signal corresponds to an emergency situation that requires the cell site be completely shut down or an immediate technician visit. Some of the adverse conditions can be controlled without a technician visiting the cell site. To do so, the cell site needs to install an automatic environmental control system. According to prior art approaches, another set of general-purpose relays

116, 120 and 124 is installed at the cell site, each coupled to one detector that detects certain changes at the cell site.

The output terminals of the relays are then coupled to a central control module 108. The central control module 108 includes a processor configured to control one or more environmental control devices such as DC load shed systems, air conditioning systems, or exhaust fans (not shown in FIG. 1) to adjust the environment at the cell site in order to maintain a desired environmental condition inside the cell site building. The central control module 108 usually controls these devices through interface modules such as DC load shed control module 130, HVAC control module 132 and fan control module 134.

For example, when the temperature at the cell site rises above a predetermined threshold level, the central control module 108 is triggered to run an algorithm to determine whether to turn on any AC unit and if so, how many active AC units are required to keep the cell site from being overheated. Based on the output of the algorithm, the central control module 108 sends control signals to the HVAC control module 132 to operate accordingly.

There is an output channel 136 between the central control module 108 and the punch-down block 110. This channel allows monitoring signals received by the central control module 108 as well as its processing results to be transferred to the site controller 112 and then to the central monitoring station located remotely.

There are multiple issues with the environmental control system shown in FIG. 1. First, the system requires the installation of an additional set of relays 116, 120 and 124 in order to detect various monitoring signals. Especially in retrofit situations, this requirement significantly increases the system's installation cost. The installation of the additional relays in a retrofit to existing equipment at the cell site, could, for example, void pre-existing safety certifications and manufacturer's warranties. Moreover, a cell site electrical standard usually requires that signal wiring associated with the additional relays be enclosed in metal conduits for equipment safety reasons. Installing these conduits, especially in retrofit situations, could also significantly increase the installation cost for the system. Yet, despite these additional costs, the system in FIG. 1 has so far been the approach adopted by the telecommunication industry.

In view of the above, it is desired to develop a new connection methodology, for the environmental control system, which monitors and controls the environment at a cell site using existing infrastructures.

SUMMARY

Accordingly, this invention provides for an improvement to a cell site environmental control system that includes multiple relays or switches, each coupled to a specific detector to detect changes to the environment at the cell site. The relays or switches transfer monitoring signals to a punch-down block in response to the environmental changes. The cell site environmental control system includes a microprocessor-based central control module coupled to the punch-down block. Upon receipt of the monitoring signals from the punch-down block, the central control module issues environmental control instructions to one or more sub-control modules to operate environmental control devices accordingly so as to maintain a stable working environment at the cell site.

In a cell site environmental control system comprising such relays, configured to deliver monitoring signals produced by detectors and coupled to a punch down block to allow the monitoring signals to a central control module, the invention comprises connecting the central control module into pre-existing infrastructure instead of installing additional relays or other signal detectors. This can be done by connecting the central control module to, for example, the existing relays or more preferably to the punch down block.

BRIEF DESCRIPTION OF THE DRAWINGS

The aforementioned aspects of the invention as well as additional aspects will be more clearly understood as a result of the following detailed description of the various embodiments of the invention when taken in conjunction with the drawings. Like reference numerals refer to corresponding parts throughout the several views of the drawings.

Like reference numerals refer to corresponding parts throughout the several views of the drawings.

DESCRIPTION OF EMBODIMENTS

Figure 2:
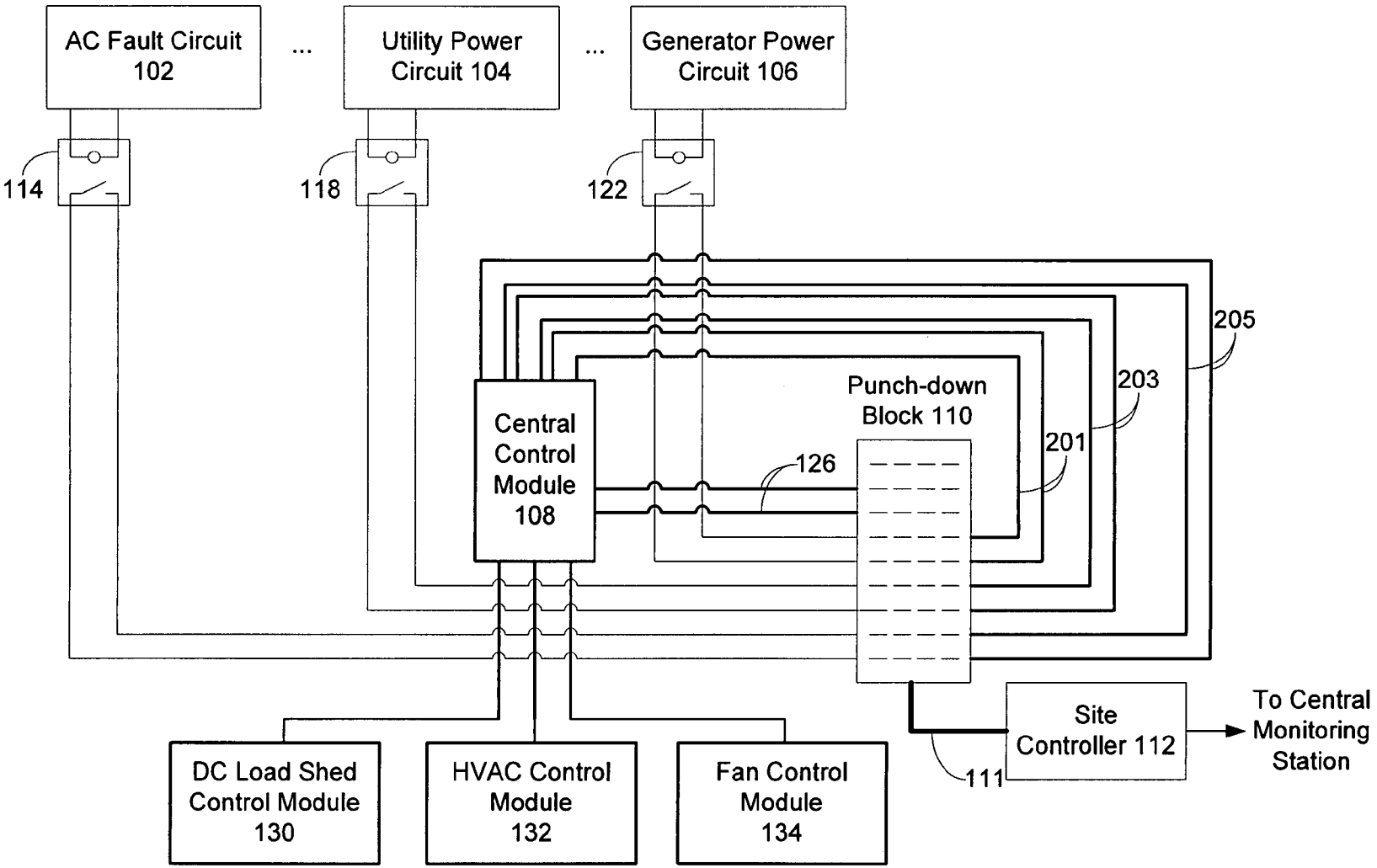
FIG. 2 is a cell site environmental control system according to some embodiments of the present invention.

FIG. 2 depicts a cell site environmental control system that maximizes a cell site's availability, reliability and energy usage efficiency through a continuous, automatic control of environmental conditions within a cell site building, according to one embodiment of the present invention.

At the center of the cell site environmental control system is a microprocessor-based central control module 108. The central control module 108 controls the environmental conditions within the cell site building by monitoring externally or internally measured status or parameters such as temperature and humidity. These measurements include the run/stop condition of air conditioner compressors and exhaust fans, the open/close status of the entrances to the building, the temperature inside and outside the building, and the voltage of the backup batteries or generators providing power supply for the cell site, etc. When the central control module 108 determines that a measured status or parameter meets a predetermined condition, it sends control signals to one or more sub-control modules to act accordingly.

For example, when the central control module 108 determines that the internal temperature of the cell site building exceeds a predetermined temperature value, it sends environmental control instructions to a fan control module 134 via a serial I/O bus. The fan control module 134 is installed near a DC exhaust fan (not shown) and contains a control relay, a motor control contactor and a processor to communicate with the central control module 108. Upon receipt of the environmental control instructions, the fan control module 134 turns on the DC exhaust fan to bring down the temperature inside the building. The DC exhaust fan is turned off when the internal temperature drops below the predetermined temperature value minus a predetermined temperature differential. The reason of having this temperature differential is to prevent the central control module 108 from being triggered repeatedly when the temperature fluctuates up and down near the predetermined temperature value.

An HVAC control module 132 is installed adjacent to an air conditioner (not shown). It includes HVAC control relays to control the operation of the air conditioner. All control wiring connections are made at this module and the module is supported by the same power supply that powers the air conditioner. There is a serial I/O bus between the HVAC control module 132 and the central control module 108. Temperature settings made at the central control module 108 are automatically updated to the HVAC control module 132 via the serial I/O bus. In some embodiments, the HVAC control module 132 is equipped with a temperature sensor. This provides redundant HVAC control in that, in the event of the central control module failure, the control of the air conditioner is automatically switched from the central control module 108 to the HVAC control module 132.

A DC load shed control module 130 is installed in close proximity to a DC power plant (not shown). Environmental control logic is communicated from the central control module 108 to the DC load shed control module 130 via a serial I/O bus. The DC load shed control module 130 monitors voltage of the DC power plant. In some embodiments, the DC load shed control module 130 contains multiple normally open control relays to manage external DC contactors. The control relays close when load shedding is called for by the central control module 108 when a predetermined condition is met. For example, all the control relays close when there is a total loss of power or system failure to the cell site environmental control system. The DC load shed control module 130 also contains multiple normally open control relays used to shunt-trip main DC power feed to the cell site in the event of a shutdown due to high temperature or external shutdown command sequence.

As mentioned above, one of the key issues for a cell site environmental control system is how to provide the central control module access to the cell site environmental status information, e.g., in the form of monitoring signals, in order to maintain a stable working environment at the cell site. For example, the central control module 108 includes logic designed for collecting information about the status of different equipment associated with a cell site, conducting analysis of the collected information and issuing appropriate environmental control instructions to the DC load shed control module 130, the HVAC control module 132 and the fan control module 134, etc. Without access to the environment-related information, the central control module 108 cannot operate any of the sub-control modules appropriately.

Figure 1:
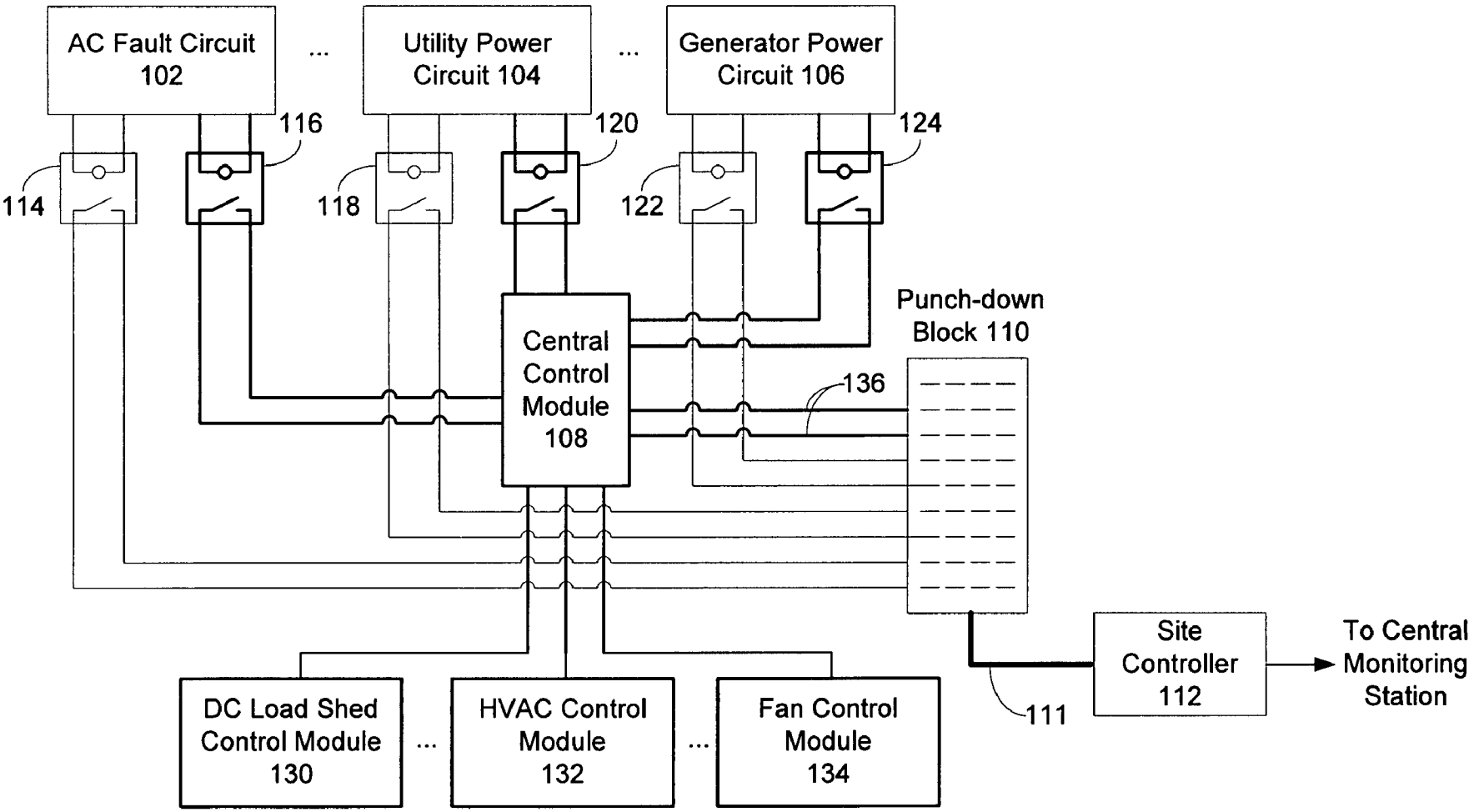
FIG. 1 (Prior Art)
FIG. 1 is a prior art environment control system deployed at a cell site.

The present invention is based on the fact that almost every device to be monitored by the central control module 108 is already being monitored by the site controller 112 via a device like a general-purpose relay or switch, and as a result, any pair of relays associated with a particular device in FIG. 1 capture identical monitoring signals. For example, when relay 114 captures an AC power failure signal associated with the AC fault circuit 102, relay 116 generally receives the same information. Thus, if the monitoring signal generated by one relay in a pair can be shared by different components of the cell site environmental control system, the other relay in the pair can be eliminated without losing any information. This approach is supported by another fact that the output terminals of the relays 114, 118 and 122 are coupled to the punch-down block 110 in order to transfer monitoring signals from the relays to the site controller 112 and then to the remote monitoring station. Therefore, it is possible for the central control module 108 to intercept the monitoring signals at a connecting device like the punch-down block 110. By doing so, there is no need for installing the additional set of relays shown in FIG. 1.

Accordingly, the new environmental control system shown in FIG. 2 eliminates the additional control relay within each pair. Instead of having additional relays (116, 120 and 124 in FIG. 1) feed signals to the central control module 108, the invention eliminates these relays and replaces them with three connections 201, 203 and 205 directly from the punch-down block 110 to the central control module 108.

Note that a monitoring signal input from relays 114, 118 or 122 is wired into the punch-down block 110 by connecting the relay to a pair of punch-down terminals in two different rows of the punch-down block 110. The punch-down block 110 usually includes multiple rows of punch-down terminals, each row of having multiple terminals being connected together. Since only one of the punch-down terminals in each row is used by a relay, the central control module 108 can receive the monitoring signal delivered from the relay by connecting to other free terminals in the same row.

FIG. 2 depicts that each input wire pair 201, 203, and 205 is connected to one pair of punch-down terminals at the punch-down block 110. For example, the wire pair 201 measures a voltage differential between the two punch-down terminals. When the measured voltage differential is greater than a predetermined threshold voltage, it indicates that the contacts at the corresponding relay 122 are open. If the measured voltage differential is less than the threshold voltage, it indicates that the contacts at the relay 122 are closed. This voltage measurement is analogous to the direct voltage measurement across the two contacts at the relay 122 using a voltmeter which has high impedance. Therefore, it does not interference with the operation of other components connected to the punch-down box 110. Alternatively, the measurement can be made directly across the contacts at the relay 122. But this would require the routing of additional electrical conduit and wiring from each relay being monitored to the central control module 108.

In sum, a monitoring signal captured by any of the existing control relays 114, 118 and 122 is sensed at the punch-down block 110 and routed to the central control module 108 through one of the connections. This new system configuration is much less expensive and easier to implement because it requires fewer control relays and less installation work. Yet, despite being less expensive, the system shown in FIG. 2 is functionally equivalent to the one shown in FIG. 1. Based on the monitoring signals re-routed from the punch-down block 110, the central control module 108 sends environmental control instructions to corresponding sub-modules to modulate various environmental parameters such as temperature and humidity at the cell site.

In addition, the central control module 108 can send its measurements and processing results to the site controller 112 through the serial I/O bus 126 between the central control module 108 and the punch-down block 110 and then to the central monitoring station at a remote location.

The foregoing description, for purpose of explanation, has been set forth with reference to specific embodiments. However, the illustrative discussions above are not intended to be exhaustive or to limit the invention to the precise forms disclosed. While some reordering or other groupings are specifically mentioned above, others will be obvious to one of ordinary skill in the art and so do not present an exhaustive list of alternatives.

What is claimed is:

1. A cell site environmental control system, comprising:

one or more switch circuits configured to cause delivery of monitoring signals in response to signals produced by one or more detectors, the one or more switch circuits including at least one of a general-purpose relay or a switch, and wherein the general-purpose relay or switch is coupled to at least one circuit selected from the group consisting of an AC fault circuit, a utility power circuit and a generator power circuit;

a connecting device coupled to the switch circuits and configured to receive the monitoring signals; and a central control module coupled to the connecting device and configured to analyze the monitoring signals and generate environmental control instructions.

2. The cell site environmental control system of claim 1, wherein the connecting device is a punch-down block having multiple rows of terminals, each row having at least one free terminal to be used by the central control module.

3. The cell site environmental control system of claim 1, wherein the central control module includes a microprocessor and a storage device hosting environmental control logic implementing predetermined algorithms, and the microprocessor is configured to generate the environmental control instructions using the environmental control logic in response to the monitoring signals.

4. The cell site environmental control system of claim 1, further comprising:

one or more sub-control modules coupled to the central control module and configured to operate environmental control devices in accordance with the environmental control instructions, the environmental control devices including DC load shed systems, air conditioning systems, and exhaust fans.

5. The cell site environmental control system of claim 1, wherein a site controller is coupled to the connecting device and configured to receive the monitoring signals delivered by the switch circuits.

6. A method of monitoring and controlling the environment at a building, comprising:

delivering monitoring signals in response to signals produced by one or more detectors from one or more switch circuits to a connecting device, the one or more switch circuits including at least one of a general-purpose relay or a switch;

routing the monitoring signals from the connecting device to a central control module coupled to the connecting device;

using the central control module and the monitoring signals to generate environmental control instructions;

controlling one or more environmental control devices using the environmental control instructions; and coupling the general-purpose relay or switch to at least one circuit selected from the group consisting of an AC fault circuit, a utility power circuit and a generator power circuit.

7. The method of claim 6, wherein the connecting device is a punch-down block having multiple rows of terminals, each row having at least one free terminal to be used by the central control module.

8. The method of claim 6, further comprising:

generating the environmental control instructions by having a microprocessor execute environmental control logic in response to the monitoring signals.

9. The method of claim 6, wherein the one or more environmental control devices include DC load shed systems, air conditioning systems, and exhaust fans.

10. The method of claim 6, further comprising:

transmitting the monitoring signals from the connecting device to a site controller.

11. In a cell site environmental control system including:

one or more switch circuits configured to deliver monitoring signals, in response to signals produced by one or more detectors, to a connecting device, the one or more switch circuits include at least one of a general-purpose relay or a switch, and wherein the general-purpose relay or switch is coupled to at least one circuit selected from the group consisting of an AC fault circuit, a utility power circuit and a generator power circuit; and a central control module configured to operate environmental control devices in response to the monitoring signals, the improvement comprising:

at least one connection from the connecting device to the central control module, in place of a connection from additional switch circuits, configured to deliver the monitoring signals, to the central control module, so that the central control module can receive the monitoring signals from the connecting device to generate environmental control instructions to operate the environmental control devices.

12. The cell site environmental control system of claim 11, wherein the connecting device is a punch-down block having multiple rows of terminals, each row having at least one free terminal to be used by the central control module.

13. The cell site environmental control system of claim 11, wherein the central control module includes a microprocessor and a storage device hosting environmental control logic implementing predetermined algorithms, and the microprocessor is configured to generate the environmental control instructions using the environmental control logic in response to the monitoring signals.

14. The cell site environmental control system of claim 11, wherein the environmental control devices include DC load shed systems, air conditioning systems, and exhaust fans.

15. A cell site environmental control system, comprising:

one or more switch circuits configured to cause delivery of monitoring signals in response to signals produced by one or more detectors;

a connecting device coupled to the switch circuits and configured to receive the monitoring signals, wherein the connecting device is a punch-down block having multiple rows of terminals, each row having at least one free terminal to be used by the central control module; and a central control module coupled to the connecting device and configured to analyze the monitoring signals and generate environmental control instructions.

16. The cell site environmental control system of claim 15, wherein the one or more switch circuits include at least one of a general-purpose relay or a switch.

17. The cell site environmental control system of claim 15, wherein the general-purpose relay or switch is coupled to at least one circuit selected from the group consisting of an AC fault circuit, a utility power circuit and a generator power circuit.

18. The cell site environmental control system of claim 15, wherein the central control module includes a microprocessor and a storage device hosting environmental control logic implementing predetermined algorithms, and them microprocessor is configured to generate the environmental control instructions using the environmental control logic in response to the monitoring signals.

19. The cell site environmental control system of claim 15, further comprising:

one or more sub-control modules coupled to the central control module and configured to operate environmental control devices in accordance with the environmental control instructions, the environmental control devices including DC load shed systems, air conditioning systems, and exhaust fans.

20. The cell site environmental control system of claim 15, wherein a site controller is coupled to the connecting device and configured to receive the monitoring signals delivered by the switch circuits.

21. A method of monitoring and controlling the environment at a building, comprising:

delivering monitoring signals in response to signals produced by one or more detectors from one or more switch circuits to a connecting device, wherein the connecting device is a punch-down block having multiple rows of terminals, each row having at least one free terminal to be used by the central control module;

routing the monitoring signals from the connecting device to a central control module coupled to the connecting device;

using the central control module and the monitoring signals to generate environmental control instructions; and controlling one or more environmental control devices using the environmental control instructions.

22. The method of claim 21, wherein the one or more switch circuits include at least one of a general-purpose relay or a switch.

23. The method of claim 21, further comprising:

coupling the general-purpose relay or switch to at least one circuit selected from the group consisting of an AC fault circuit, a utility power circuit and a generator power circuit.

24. The method of claim 21, further comprising:

generating the environmental control instructions by having a microprocessor execute environmental control logic in response to the monitoring signals.

25. The method of claim 21, wherein the one or more environmental control devices include DC load shed systems, air conditioning systems, and exhaust fans.

26. The method of claim 21, further comprising:

transmitting the monitoring signals, from the connecting device to a site controller.

27. In a cell site environmental control system including:

one or more switch circuits configured to deliver monitoring signals, in response to signals produced by one or more detectors, to a connecting device, wherein the connecting device is a punch-down block having multiple rows of terminals, each row having at least one free terminal to be used by the central control module; and a central control module configured to operate environmental control devices in response to the monitoring signals, the improvement comprising:

at least one connection from the connecting device to the central control module, in place of a connection from additional switch circuits, configured to deliver the monitoring signals, to the central control module, so that the central control module can receive the monitoring signals from the connecting device to generate environmental, control instructions to operate the environmental control devices.

28. The cell site environmental control system of claim 27, wherein the one or more switch circuits include at least one of a general-purpose relay or a switch.

29. The cell site environmental control system of claim 27, wherein the general-purpose relay or switch is coupled to at least one circuit selected from the group consisting of an AC fault circuit, a utility power circuit and a generator power circuit.

30. The cell site environmental control system of claim 27, wherein the central control module includes a microprocessor and, a storage device hosting environmental control logic implementing predetermined algorithms, and the microprocessor is configured to generate the environmental control instructions using the environmental control logic in response to the monitoring signals.

31. The cell site environmental control system of claim 27, wherein the environmental control devices include DC load shed systems, air conditioning systems, and exhaust fans.

* * * * *